United States Patent [19]

Ryckman

[11] 4,286,938

[45] Sep. 1, 1981

[54] OVAL DISH FORMER

[75] Inventor: George Ryckman, East Liverpool, Ohio

[73] Assignee: Service (Engineers) Limited, Stoke-on-Trent, England

[21] Appl. No.: 29,288

[22] Filed: Apr. 12, 1979

[51] Int. Cl.[3] ..... B28B 1/02

[52] U.S. Cl. ..... 425/265; 425/266; 425/267; 425/268; 425/405 R; 425/409; 425/429

[58] Field of Search ..... 425/267, 268, 265, 405 R, 425/263, 266, 409, 429

[56] References Cited

U.S. PATENT DOCUMENTS

| | | | |
|---|---|---|---|
| 765097 | 12/1953 | GBX . | |
| 2,485,159 | 10/1949 | Malarkey | 425/268 |
| 2,599,910 | 6/1952 | Guthrie . | |
| 2,729,870 | 1/1956 | Guthrie . | |
| 3,751,206 | 8/1973 | Bradshaw et al. | 425/625 |
| 3,778,212 | 12/1973 | Takahashi | 425/625 |

FOREIGN PATENT DOCUMENTS

| | | |
|---|---|---|
| 621712 | 4/1949 | United Kingdom . |
| 657544 | 9/1951 | United Kingdom . |
| 676428 | 7/1952 | United Kingdom . |
| 765097 | 12/1953 | United Kingdom . |

*Primary Examiner*—John Parrish
*Attorney, Agent, or Firm*—Harpman & Harpman

[57] ABSTRACT

An oval dish forming machine has two revolvable wheels each of which is supported on a structure permitting the wheel to move in an eccentric pattern so that discs of clay on carriers on the wheels may be formed in desirable oval shapes. One of the wheels comprises a first or spreading station where the disc of clay is subjected to a rolling extruding action of a cone-shaped roller which squeezes the clay against the carrier to form a desirable oval shape. The carrier and the initially shaped clay is then manually moved to a second or finishing station where a dumbbell shaped roller engages the clay shape on the carrier and rolls the excess clay from the shape to the desired configuration of the oval dish. The dumbbell shaped roller is stopped in the last revolution of the wheel so as to smooth the clay by a sliding action. Motion of the two shaping and finishing rollers is controlled to properly process and shape the clay so as to insure the removal of air and excess moisture therefrom. The wheels in both stations are driven simultaneously by a common driving mechanism through eccentric motion devices.

15 Claims, 13 Drawing Figures

OVAL DISH FORMER

BACKGROUND OF THE INVENTION (1) Field of the Invention

This invention relates to machines for forming oval dishes which have heretofore been formed by hand on potter's wheels requiring considerable skill and effort in shaping a batt of clay into a rough circular shape through the use of a blade held thereagainst and peeling the shaped batt from the wheel and forcefully positioning it on a plaster mold and then smoothing the revolving clay batt with a blade and the potters fingers to eliminate air inclusions and finally applying wet hands to press the clay down on the plastic mold and push the air and excess moisture into the plaster. These heretofore common manual steps introduced strain in the ware and usually required the drying of the shaped ware to reduce the high moisture content of the shaped clay to insure shape retention thereof.

(2) Description of the Prior Art

The prior art machines for shaping ceramic ware are typically illustrated in U.S. Pat. Nos. 2,599,910 and 2,729,870 and in British Pat. Nos. 621,712, 657,544, 676,428 and 765,097.

In the first of the above mentioned U.S. Pat. No. 2,599,910, a manually operated tool for forming dinnerware is disclosed wherein a forming tool in the shape of a roller is presented to the clay in angular relation and its rate of presentation and pressure are dependent upon the operator and his skill in operating the machine.

In the present invention the machine completely replaces the manual operator in that it precisely and exactly first roughly shapes the clay batt while kneading it so as to spread it into a desired shape and then finishes it by again exerting a carefully programmed shaping and smoothing action which results in a shaped clay piece free of strain, air inclusions, and excess moisture.

The second of the above mentioned U.S. Pat. No., 2,729,870, discloses a roller tool jiggering machine for forming containers and wherein the inner surface of the container is engaged and shaped by the tool.

In the present invention the spreading stage and finishing stage portions of the machine process a clay batt through the several steps necessary to produce an oval dish of proper consistency and desirable quality.

The British patent specifications all relate to the shaping of clay ware and British Pat. No. 621,712 discloses the use of a roller shaping tool on a mold and wherein the tool is manually engaged against the clay.

British Pat. No. 657,544 discloses a motor driven cone-shaped shaping tool engaging a clay batt on a mold on a rotating table. Little or no variation in the presentation of the tool to the clay is possible or contemplated in the disclosure.

In British Pat. No. 676,428 a motor driven rotary tool is presented to a clay shape on a mold, provides for a relative rotary movement between the shaping surface of the tool and the surface of the clay and does not permit pressure variation of the tool with respect to the clay as necessary in properly processing the same as hereinbefore described in connection with the present invention.

British Pat. No. 765,097 discloses a machine incorporating a rotary shaping tool which engages flat clay on a rotary mold with the tool being shaped so that the center of the tool engages the center of the clay being shaped. The device does not provide for the power driven downward action and the rocking motion necessary to produce the correct flow of the clay in the spreading stage.

SUMMARY OF THE INVENTION

An oval dish forming machine is disclosed which combines means for shaping a clay batt in a first spreading stage by engaging the clay batt with a cone-shaped spreader roller rotating at the same speed as the clay batt on its supporting plaster mold and wherein the spreader roller supplies a pre-programmed variable pressure and rocking motion to the clay batt to spread the same into a desired clay shape on the plaster mold. The spread shape on its plaster mold carrier is then transferred manually to a finishing station in the machine which operates simultaneously with the spreading station and wherein a dumbbell shaped finishing roller is moved under proper tension and control in a free revolving action against the revolving clay shape on its plaster mold carrier in the finishing station. Both the spreading station and finishing station comprise wheels on spindles which are rotated eccentrically and wherein the degree of eccentricity is adjustable so as to enable the predetermination of the length and width of the oval dish being formed. A clay piece in the spreading stage and in the finishing stage is subjected to a novel programmed series of actions which are cam operated and individualized to achieve the desired results in each of the spreading and finishing stations of the machine.

DESCRIPTION OF THE PREFERRED EMBODIMENT

Figure 1:
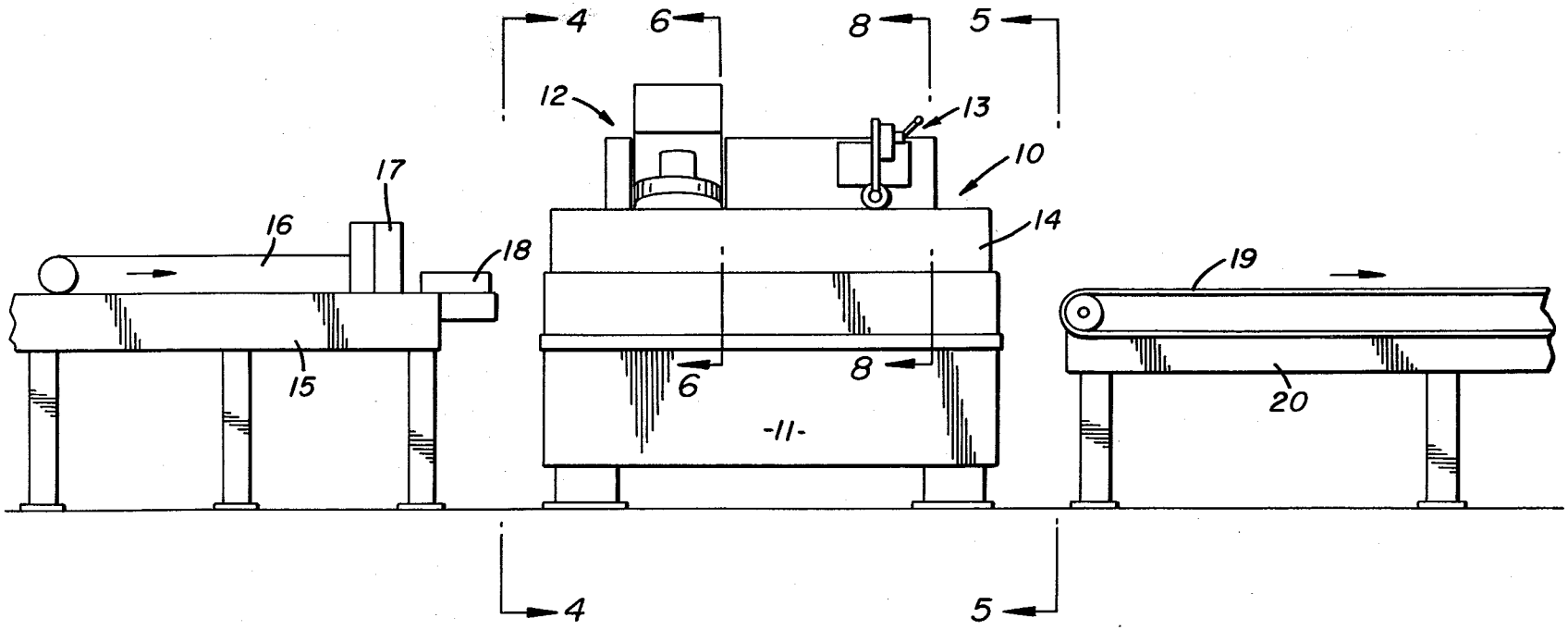
FIG. 1 is a front view of the oval dish former positioned between a clay batt applying device and a conveyor.

By referring to FIG. 1 of the drawings, it will be seen that an oval dish forming machine is generally indicated by the numeral 10 and comprises a supporting structure 11 which has a spreading station mechanism generally indicated at 12 and a finishing station generally indicated at 13. The supporting structure 11 encloses a driving mechanism as hereinafter described which imparts controlled eccentric motion to spindles and wheels located behind a guard 14 of the machine as seen in FIG. 1 of the drawings. The spreading station 12 incorporates means for engaging plastic clay on a porous plaster mold as hereinafter described and the finishing station 13 incorporates means for engaging the spread clay on its porous plaster mold carrier to finish the same.

In FIG. 1 of the drawings a table 15 is located to the left of the oval dish forming machine 10 and is illustrated as supporting a slug of plastic clay 16. A cut-off device 17 cuts a slug of the semi-rigid plastic clay 16 which is then manually positioned on a mold and carrier as hereinafter described. The desirably shaped clay piece on its mold and carrier is removed from the finishing station 13 and positioned on a conveyor 19 on a secondary table 20 at the right hand side of the oval dish forming machine 10, the only manual operation comprising positioning the cut slug 18 on the mold carrier in the spreading station 12, moving the spread clay on the mold carrier from the spreading station 12 to the finishing station 13 and finally moving the shaped clay on the mold carrier from the finishing station 13 to the conveyor 19 where the shaped clay still on the mold carrier moves to its next point of processing such as drying and/or firing as will be understood by those skilled in the art.

Figure 2:
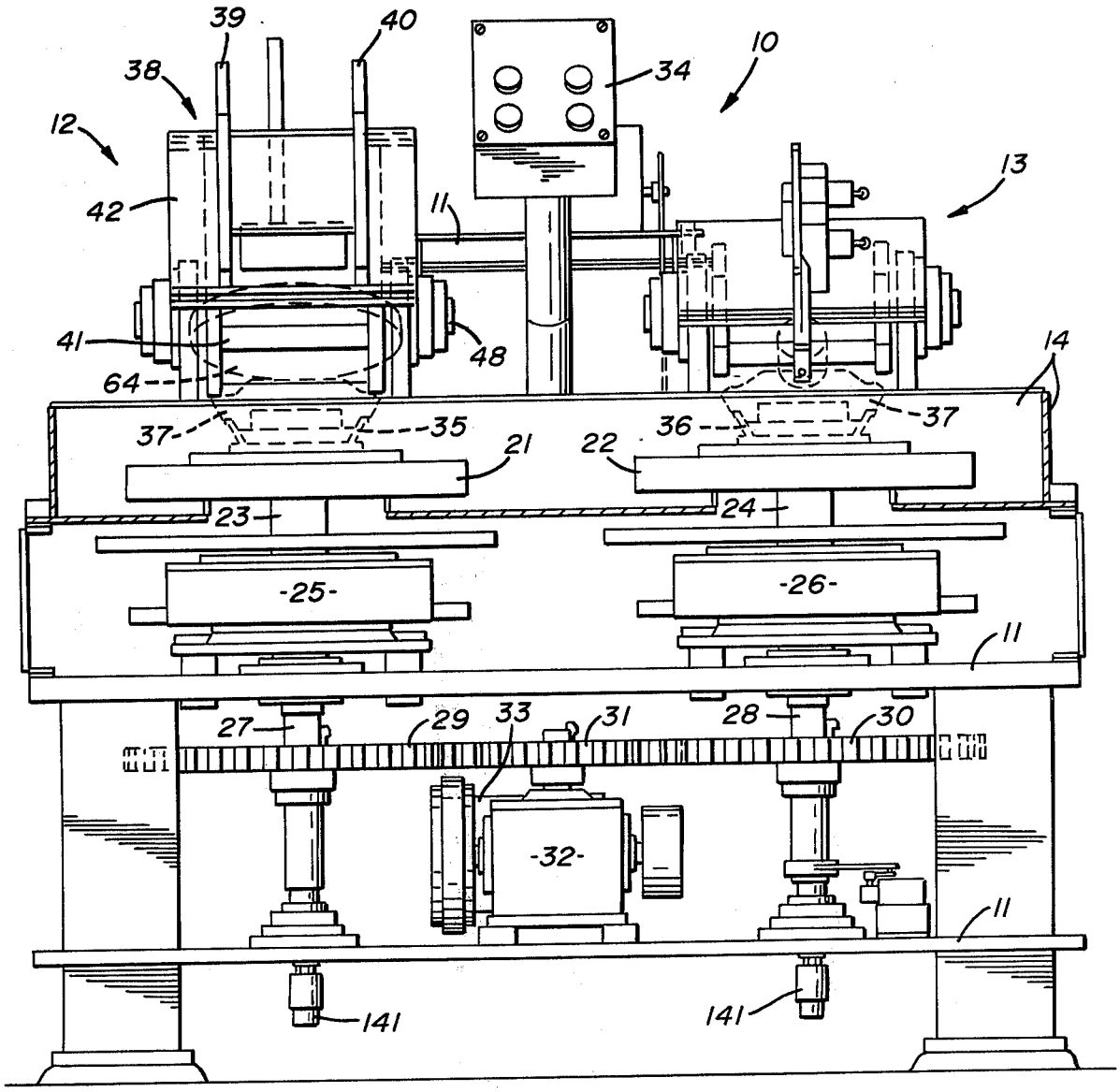
FIG. 2 is an enlarged front view of the oval dish former seen in FIG. 1 with the operating mechanism being illustrated, broken lines indicate the clay batt on its plaster mold or carrier.

By referring now to FIG. 2 of the drawings, an enlarged front detailed view of the oval dish forming machine 10 may be seen in which the front portion of the guard 14 has been removed along with the front panels which normally enclose the driving mechanism and the eccentric motion devices.

In FIG. 2 of the drawings, a pair of wheels 21 and 22 are shown attached to the upper end of spindles 23 and 24 which are supported by and rotated eccentrically by eccentric motion devices 25 and 26. Driving shafts 27 and 28 impart rotary motion to the eccentric motion devices 25 and 26 respectively and are in turn rotated, for example 200 rpm, by gears 29 and 30 on the shafts 27 and 28 respectively and engaged with a common gear 31 on a gear box 32 which is driven by an electric motor 33. The motor 33 is controlled by a switch on a switch box 34. Each of the wheels 21 and 22 incorporate vacuum chucks 35 and 36 respectively arranged to receive and hold porous plaster molds 37 which also serve as carriers for the clay being processed in the oval dish forming machine.

In FIG. 2 of the drawings, the wheel 21 and its vacuum chuck 35 are positioned beneath a work head generally indicated by the numeral 38 and comprising a pair of arms 39 and 40 which are joined at their outermost ends by a cross piece 41 and at their opposite or innermost ends by a plate 42.

Figure 6:
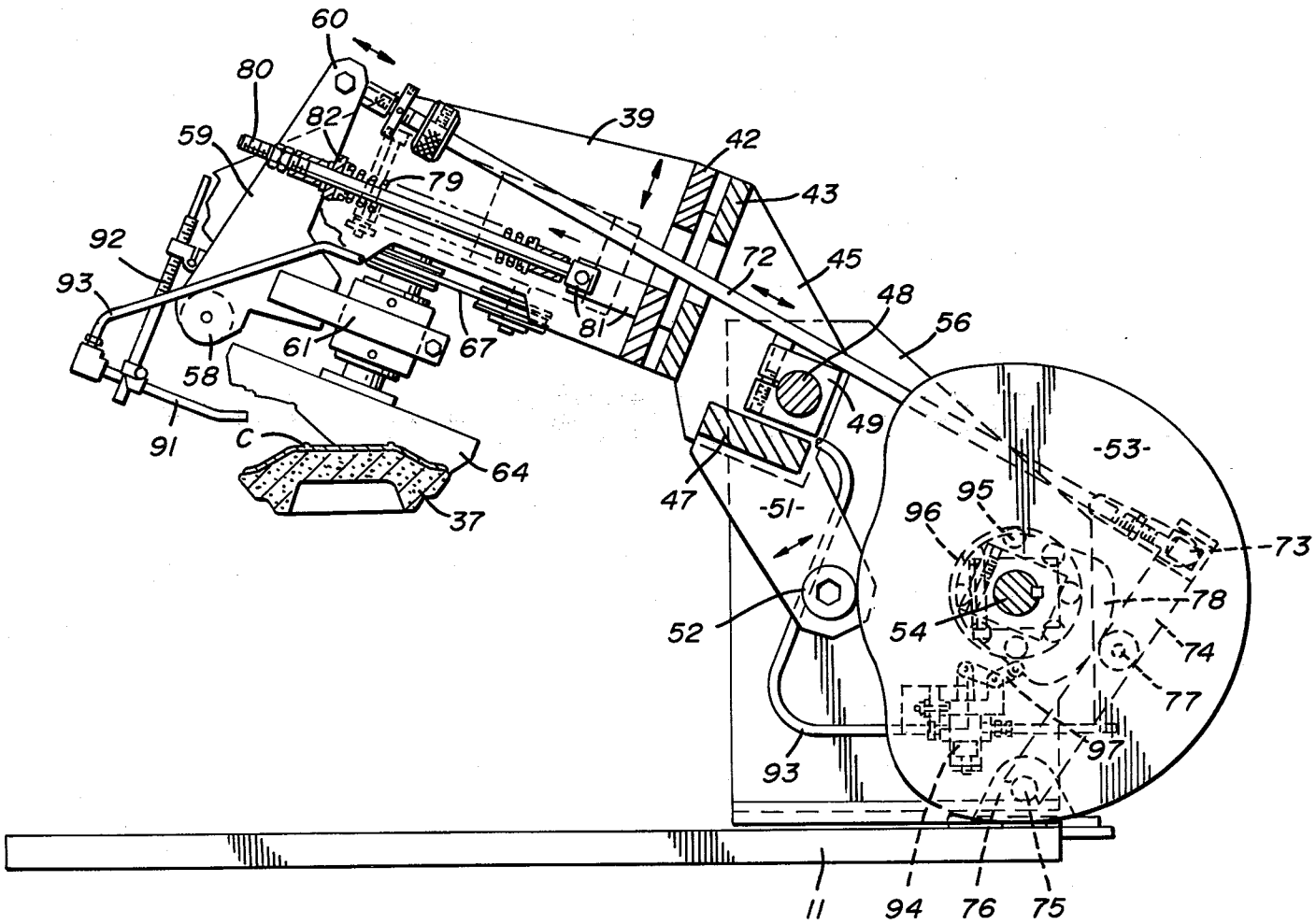
FIG. 6 is a side elevation in enlarged detail with parts broken away and parts in cross section as taken on line 6—6 of FIG. 1.
Figure 7:
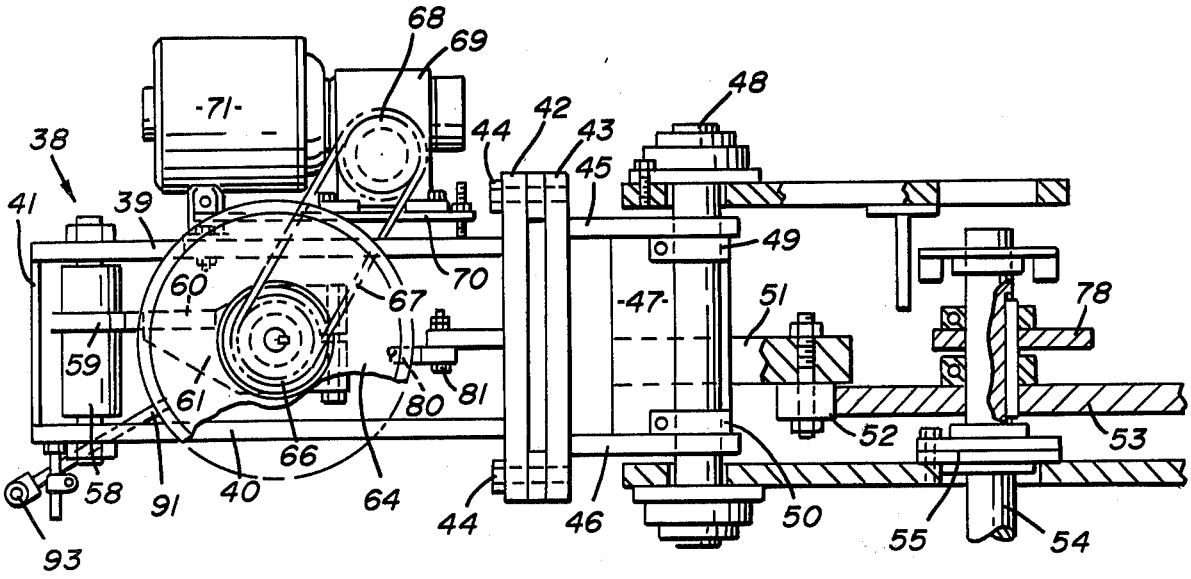
FIG. 7 is a top plan view of a portion of the machine seen in FIG. 6 of the drawings.

By referring now to FIGS. 2, 3, 4 and 7 of the drawings, it will be seen that the plate 42 and the arms 39 and 40 and the cross piece 41 form a sub-assembly which is fastened to a secondary plate 43 by fasteners 44 as best seen in FIG. 7 of the drawings. A pair of secondary arms 45 and 46 are attached to the secondary plate 43 and extend outwardly and downwardly therefrom as best seen in FIG. 6 of the drawings, and are in turn secured to one another by a secondary cross piece 47 adjacent their lowermost ends. The secondary arms 45 and 46 are apertured so that they can be pivotally mounted on a shaft 48 by means of bearing blocks 49 and 50 secured to the inner sides of the secondary arms 45 and 46. A cam arm 51 extends outwardly and downwardly from the secondary cross piece 47 and has a cam roller 52 thereon which is engaged against the periphery of a cam disc 53 which in turn is mounted on a cam shaft 54 which extends horizontally across the rear portion of the oval dish forming machine and is journaled in bearings 55 transversely of a plurality of upright frame members 56.

By referring now to FIGS. 3, 4, 6 and 7 of the drawings, it will be seen that the arms 39 and 40 extend outwardly and downwardly from the plate 42 where their outermost ends form a nose 57. A cylindrical member 58 is journaled between the arms 39 and 40 in the nose portion 57 and a rocker arm 59 is attached to the cylindrical member 58 and extends upwardly therefrom to an upper end 60. A secondary rocker arm 61 is secured to the rocker arm 59 and extends inwardly of the nose 57 toward the shaft 48 heretofore described. The secondary rocker arm 61 mounts a bearing cartridge 62 which in turn positions a rotatable shaft 63, the lower end of which carries a flattened cone-shaped roller 64. The lower surface of the cone-shaped roller 64 has the desired configuration of the bottom of the oval dish being formed on the machine.

Figure 4:
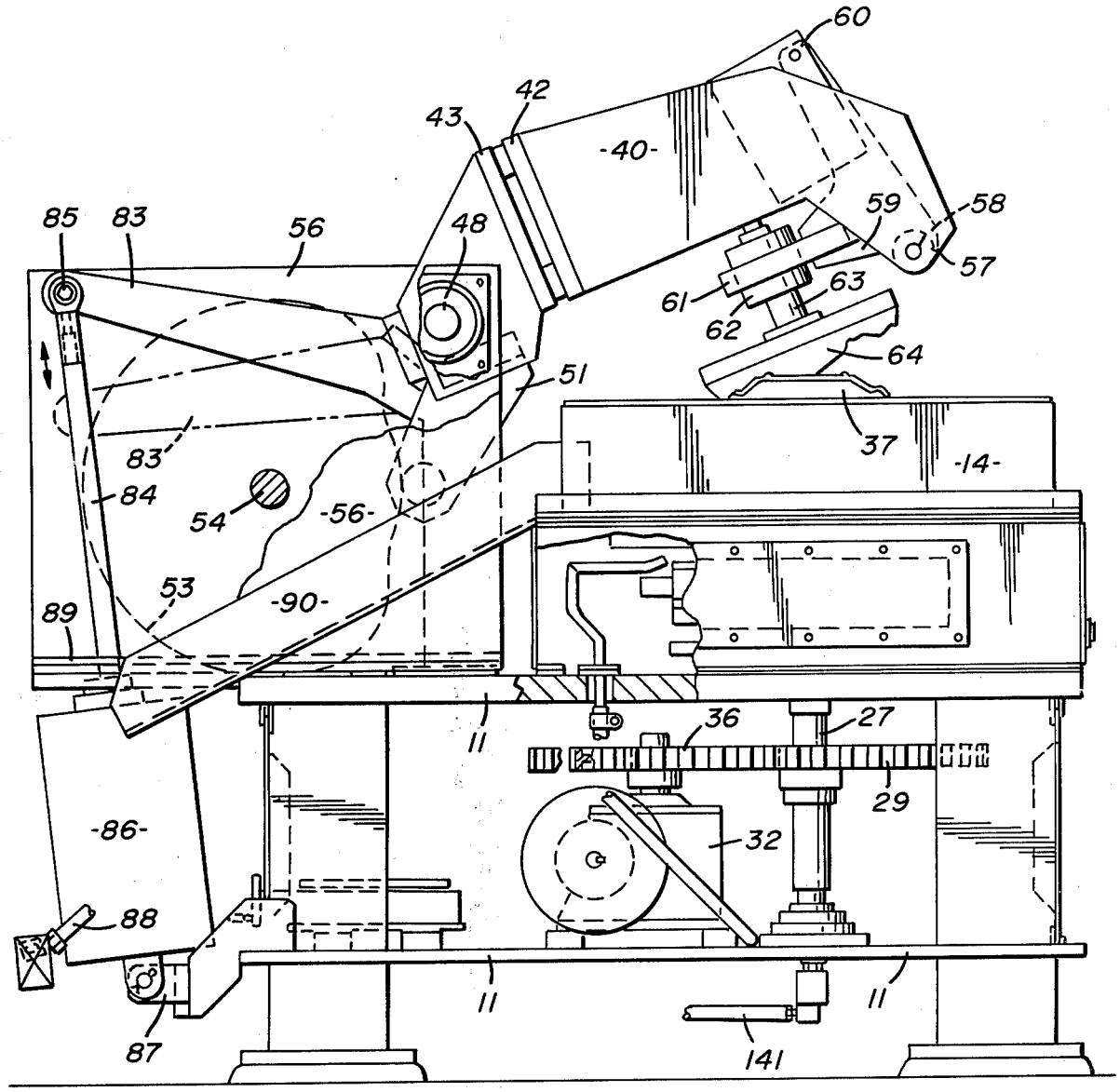
FIG. 4 is a side elevation in enlarged detail taken on line 4—4 of FIG. 1.

In FIGS. 2, 4 and 6 of the drawings, the cone-shaped roller 64 is illustrated in partial engagement with clay on a porous plaster mold and carrier 37. An enlarged cross sectional detail of one of the devices 37 may be seen in the upper portion of FIG. 11.

By referring again to FIGS. 3, 4, 6 and 7 of the drawings, it will be seen that the rotatable shaft 63 which carries the flattened cone-shaped roller 64 has a pulley 66 on its uppermost end with a belt 67 trained thereover and over a second pulley 68 on a secondary gear box 69 mounted on a support 70 along with a driving electric motor 71. The support 70 is adjustably positioned on the arm 39 of the work head being described. The arrangement is such that energization of the driving electric motor 71 as by one of the switches on the switch box 34 imparts rotation to the cone-shaped roller 64 which rotation is substantially the same as the rotation of the wheel 21 and spindle 23 which carry the porous plaster mold 37 and the clay batt being spread and initially shaped.

Figure 3:
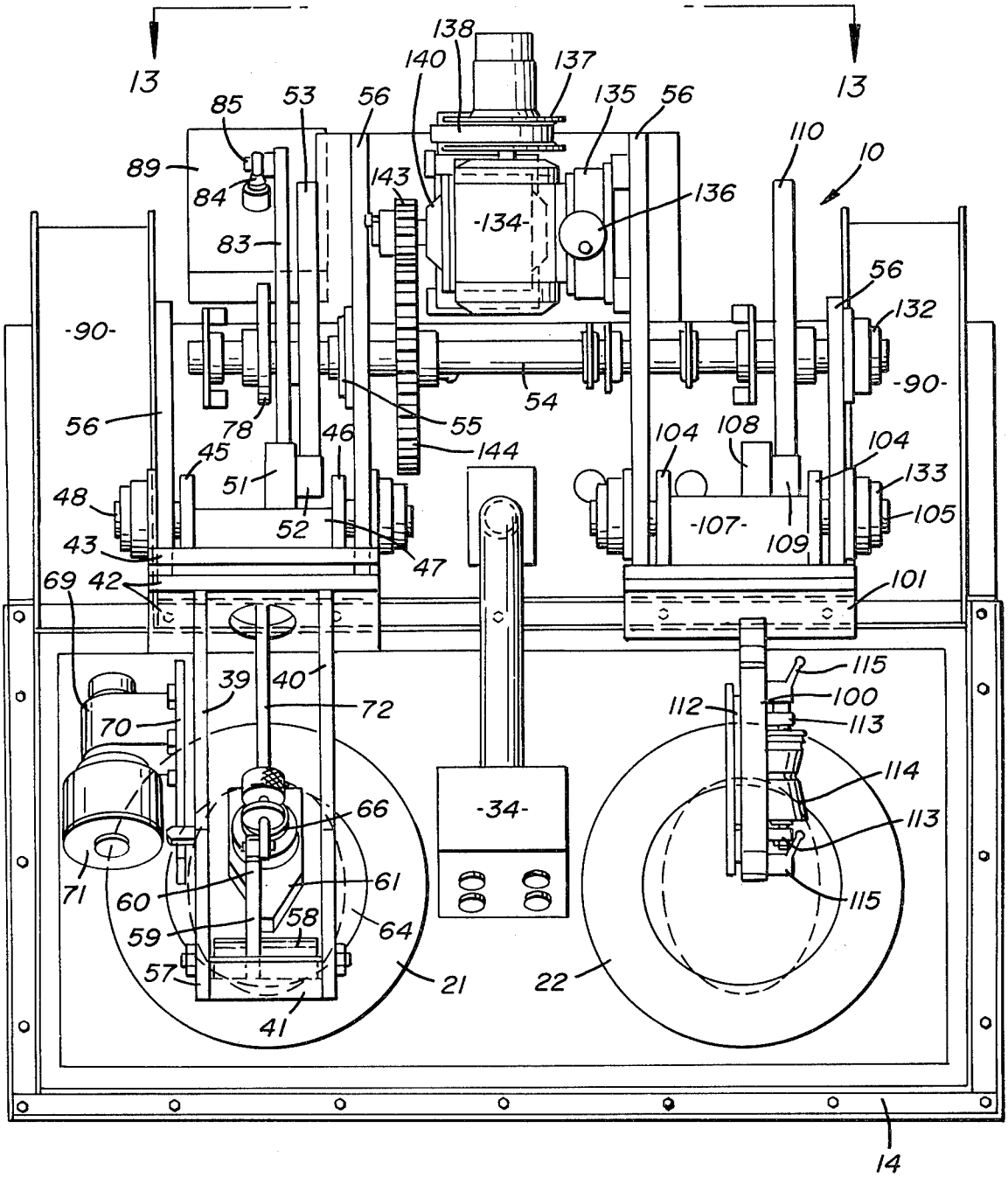
FIG. 3 is a top plan view of the oval dish forming machine seen in FIG. 2.

By referring now to FIGS. 3 and 6 in particular, it will be seen that the upper end 60 of the rocker arm 59 is adjustably and movably attached to one end of a rod 72 which extends inwardly therefrom through apertures in the plates 42 and 43 to a pivotal attachment 73 on the upper end of a secondary rocker arm 74, the lower end of which is pivoted as at 75 to a bracket 76 on a portion of the supporting structure 11. A secondary cam roller 77 on the secondary rocker arm 74 is positioned for engagement with a secondary cam 78 on the cam shaft 54.

Tensioning means is provided to insure the retention of the secondary cam roller 77 against the secondary cam 78 and comprises a coil spring 79 positioned on a rod 80, one end 81 of which is affixed to the plate 42 and the other end of which is adjustably attached by a fitting 82 to the rocker arm 59.

The work head just described and comprising the spreading station of the oval dish forming machine will thus be seen to position the cone-shaped roller 64 against the clay to be initially shaped thereby and that the clay on its supporting plaster mold and carrier 37 is revolving in an eccentric action therebeneath. The work head of the spreading station engages the roller 64 against the clay on one side of the eccentric pattern the clay on the plaster mold and carrier 37 is following, as will be understood by those skilled in the art.

More importantly the work head moves the roller 64 against the clay in a desirable pressuring action as predetermined by the shape of the cam disc 53, while simultaneously rocking the roller 64 as a result of the rocking action imparted thereto by the rocker arm 59 and its motion originated by the secondary cam 78.

As hereinbefore described, the combination of the controlled pressure application of the roller 64 to the clay and the rocking motion of the roller 64 result in the very desirable shaping of the clay batt with the results equal to or better than the best heretofore manual shaping by a skilled potter.

It will occur to those skilled in the art that the plasticity of the clay slug being worked may vary as may the shape and thickness of the piece being initially shaped by the cone-shaped spreader roller 64 and in order to add desirable additional pressure as exerted by the roller 64 on the clay batt on its plaster mold and carrier 37 an auxiliary tensioning device may be and preferably is incorporated in the spreading station work head.

In FIGS. 3 and 4 of the drawings, the auxiliary tensioning device may be seen to comprise a tensioning arm 83 attached at its inner end to the cam arm 51 and extending rearwardly therefrom, to the left in FIG. 4, the tensioning arm 83 is pivoted at its outer end to a piston rod 84 by a pivot 85. The piston rod 84 extends downwardly and into a pneumatic piston and cylinder assembly 86 which is movably mounted at its lower end on a bracket 87 on the structural support 11. Flexible air hoses 88 extend to a valve controlled source of compressed air, the valves being actuated by cams on the cam shaft 54 so that air pressure delivered to the lower end of the cylinder 86 will move the piston therein and the piston rod 84 upwardly along with the tensioning arm 83 and thereby add downward directed tension to the work head and the roller 64 carried thereby.

In FIG. 3 of the drawings, the upper end of the pneumatic cylinder 86 is covered by a shield 89 which is part of the housing generally enclosing the device to protect the mechanism thereof from the clay spun off and disgarded in the shaping and finishing stations of the machine.

In FIGS. 3 and 4 of the drawings, disposal chutes 90 may be seen extending from the area of the wheels 21 and within the guards 14. Those skilled in the art will recognize the lubrication of the clay batt during its forming and shaping is essential and in FIG. 6 of the drawings a nozzle 91 is provided on an adjustable support 92, the nozzle being in communication with a tube 93 which extends to a source of lubricant such as oil under pressure which is controlled by a valve 94 in a series of alternate on/off actions which are originated by buttons 95 on a disc 96 on the cam shaft 54 which are arranged to engage and release a valve actuating lever 97.

When the clay batt on its plaster mold and carrier 37 is shaped after the desired number of revolutions on the wheel 21, the oval dish forming machine stops the rotation of the wheels 21 and 22 and the roller 64 by reason of cam controlled switches actuated by the cam shaft 54 and appropriately shaped cams thereon. Simultaneously the work head carrying the cone-shaped spreader roller 64 moves upwardly to a location spaced above the shaped clay batt on its plaster mold and carrier 37 as does the similar work head of the finishing station 13 heretofore referred to. The operator then manually removes the mold and carrier 37 with the clay shape thereon and positions this on the vacuum chuck 36 of the wheel 22 and adds a new plaster mold and carrier 37 with a new slug of plastic clay to the wheel 21 in the spreading station 12. The machine may be arranged to automatically start its recycling or it may be manually controlled by a switch on the switch box 34 and in the latter event, which is preferable, the operator then starts the machine whereupon the hereinbefore described cycle of the work head carrying the roller 64 is repeated while simultaneously the finishing stage work head seen at the right hand side of FIGS. 2 and 3, begins its cam controlled cycle wherein the clay shape is finished.

In FIGS. 2, 3, 5, 8 and 9 of the drawings, the details of the finishing station may be seen to comprise a support arm 100 which extends outwardly over the wheel 22 and is carried by a third plate 101 which in turn is attached to a fourth plate 102 by fasteners 103. A pair of secondary support arms 104 are attached to the fourth plate 102 and extend inwardly therefrom and are apertured for pivotal engagement about a pivot shaft 105. Bearing blocks 106 on the inner sides of the secondary support arms 104 are provided. A secondary cross piece 107 extends between the secondary support arms 104 and has a secondary cam arm 108 is secured thereto which extends downwardly and rearwardly with respect to the secondary support shaft 105. A cam roller 109 on the secondary cam arm 108 is engaged against the periphery of a support arm actuating cam disc 110 which is secured to the cam shaft 54 heretofore referred to.

By referring again to the support arm 100, it will be seen that it adjustably mounts a support arm plate 112, the lower end of which has spaced apertured brackets 113 thereon which are arranged to receive extending end shafts of a dumbbell shaped finishing roller 114.

Figure 5:
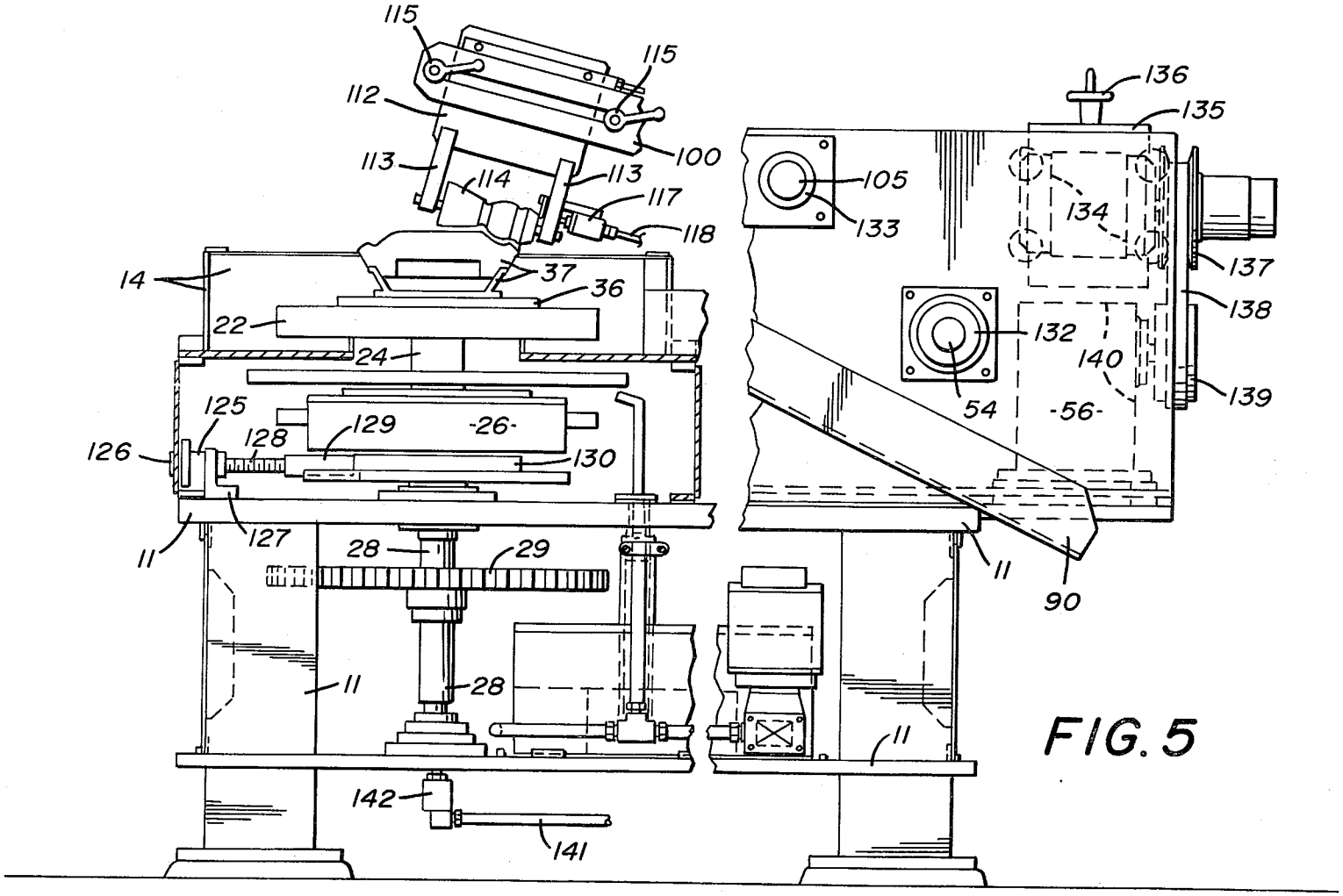
FIG. 5 is a side elevation in enlarged detail taken on line 5—5 of FIG. 1, a portion of the device is shown in an uppermost position.
Figure 8:
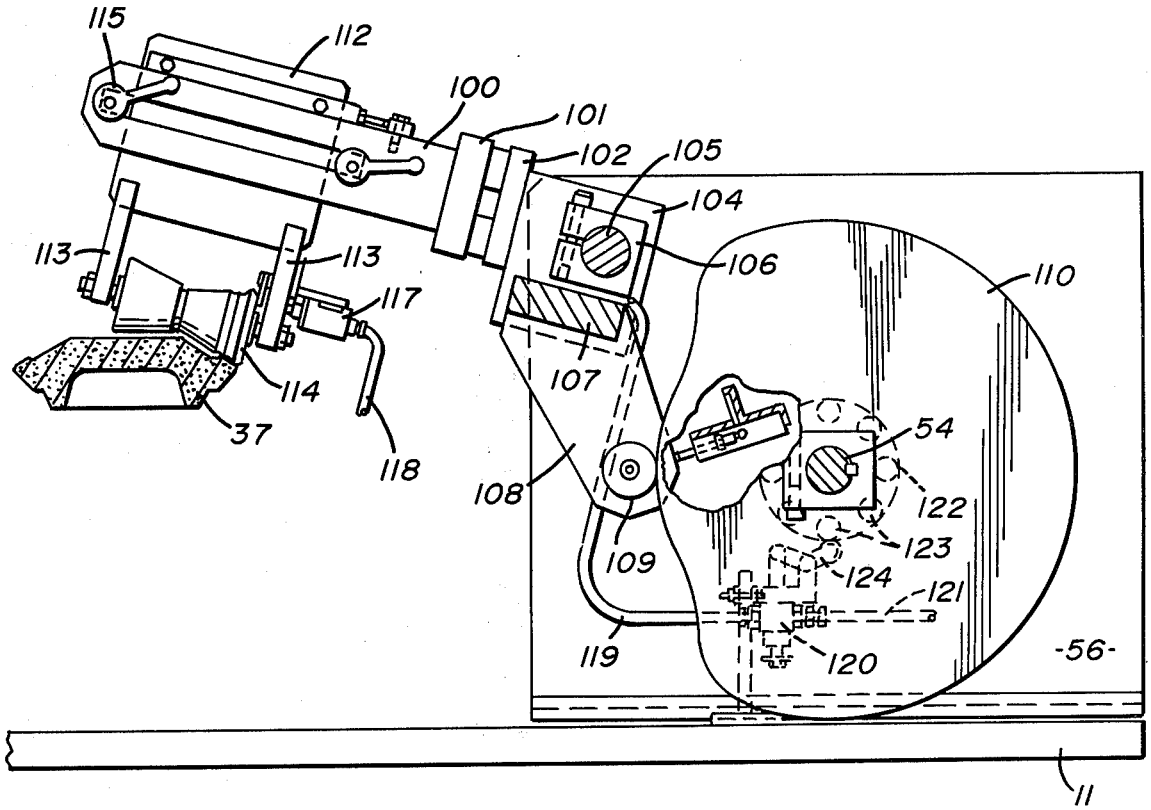
FIG. 8 is an enlarged detailed side elevation with parts broken away illustrating a portion of the machine seen in FIG. 5 of the drawings as taken on line 8—8 of FIG. 1.
Figure 9:
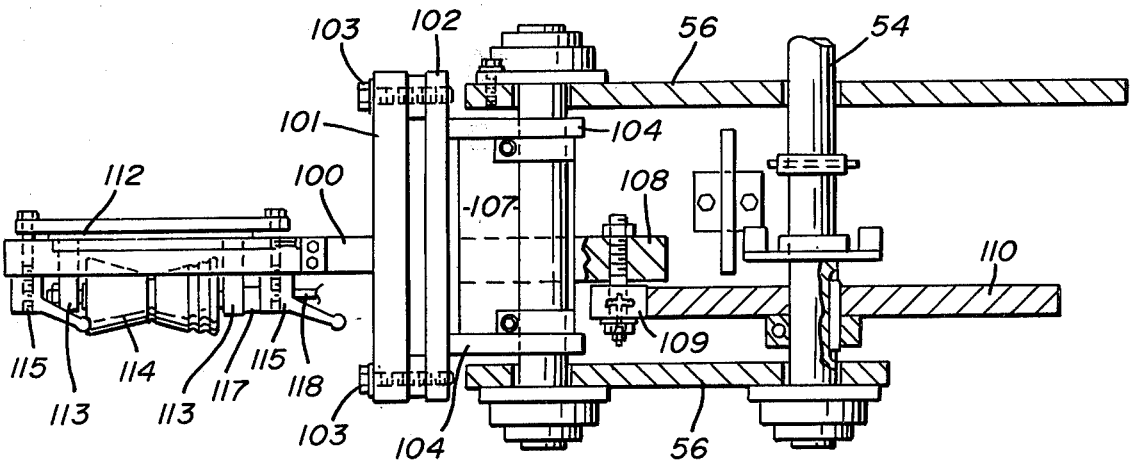
FIG. 9 is a top plan view with parts in cross section and parts broken away illustrating the portion of the machine seen in FIG. 8 of the drawings.

In FIGS. 2, 5 and 8 of the drawings, the finishing roller 114 is seen in operative relation to one of the porous plaster mold and carriers 37 on which the spread clay shape, heretofore referred to is positioned.

The support arm plate 112 is adjustably positioned on the support arm 100 by a pair of manually operable fasteners 115 which are engaged in the plate 112 and extend through a slot in the support arm 100. The arrangement is such that the vertically positioned support arm plate and its depending brackets 113 which mount the roller 114 can be adjustably positioned and/or replaced on the support arm 100.

By referring now to FIG. 8 of the drawings in particular, it will be seen that an air actuated brake 117 is mounted on one of the brackets 113 and connected to an air supply source by a flexible air supply tube 118. The air supply source may comprise an air pump operated by an electric motor and a valve controls the air pressure communicating with the tube 118 and the valve is actuated by an air control cam on the cam shaft 54, the arrangement being such that when the finishing cycle is substantially completed, such as just prior to the last revolution of the wheel 22, the air brake 117 is actuated to stop the otherwise free rotation of the dumbbell shaped finishing roller 114 whereupon it slides on the finished clay shape and provides a smooth finished surface.

Those skilled in the art will observe that lubrication is necessary in this finishing operation and a lubricant supply line 119 leads to a nozzle positioned for directing lubricant on the clay shape adjacent the dumbbell shaped finishing roller 114. The lubricant supply line 119 is controlled by a valve 120 which communicates with the lubricant supply source heretofore referred to as by a lubricant line 121. A lubricant control disc 122 on the cam shaft 54 is provided with a plurality of buttons 123 which are positioned for engagement with an actuating lever 124 by means of which the valve 120 is alternately opened and closed.

In FIG. 5 of the drawings, the support arm 100, the support arm plate 112 and the roller 117 are shown in working position relative to the clay on the plaster mold and carrier 37 which in turn is located on the wheel 22 on the spindle 24. The eccentric motion imparting device 26 is shown with an adjustment device 125 engaged thereagainst which device comprises a wrench receiving socket 126 rotatably positioned in a bearing support 127 and attached to a threaded screw 128. The screw 128 is therefore revolvable by a wrench engaged in the socket 126. The opposite end of the screw 128 is engaged in a follower 129 which is attached to a member 130 which is thereby movable toward and away from the spindle 28 so that the desired degree of eccentricity to be imparted the spindle 24 may be realized. The eccentric motion device 26 is further illustrated and described in connection with FIGS. 10, 11 and 12 of the drawings.

Still referring to FIG. 5 of the drawings, parts of which are broken away, it will be seen that the vertical support member 56 is illustrated as positioning bearing enclosures 132 and 133 respectively, which journal the ends of the cam shaft 54 and the secondary support shaft 105 respectively. Broken lines in FIG. 5 illustrate an electric motor 134 which is mounted on a vertically slidable member 135 and which is adjustable vertically by a manual handle 136 (see also FIGS. 3 and 13). The motor 134 drives a pulley 137 over which a belt 138 is trained and by which motion is imparted to a second pulley 139 on a gear reduction box 140 which is provided for driving the cam shaft 54 which is positioned adjacent thereto as best seen in FIGS. 3 and 13.

In FIG. 5 a vacuum line 141 is shown in communication with a fitting 142 which communicates with the interior of the spindle 28.

Figure 13:
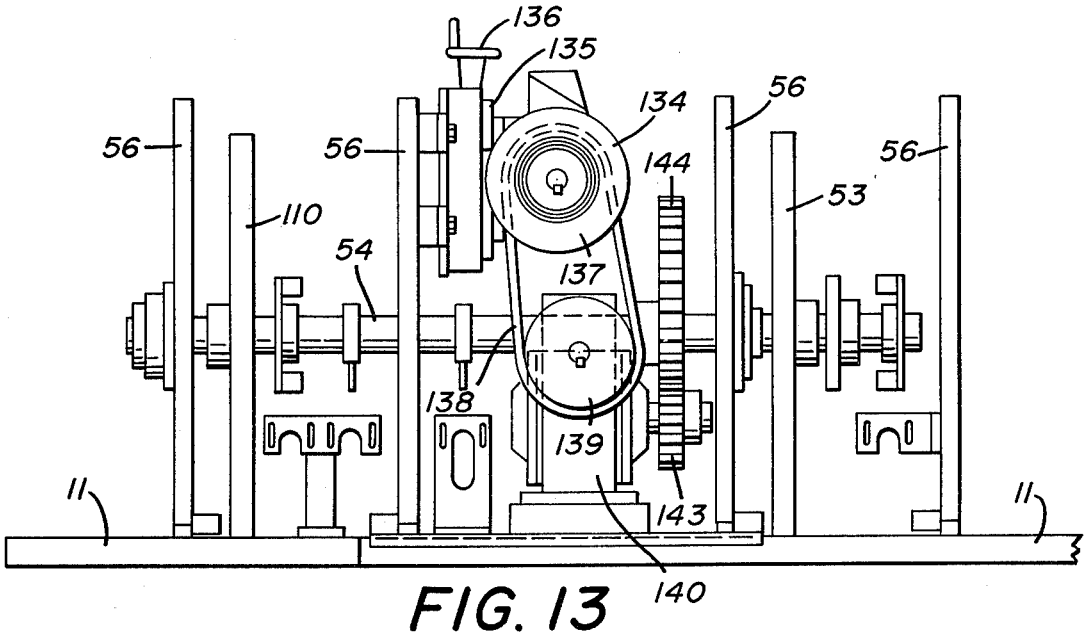
FIG. 13 is a plan view of the driving mechanism for the cone-shaped spreader roller and dumbbell shaped rollers used in the spreading and finishing stations of the oval dish forming machine.

By referring now to FIGS. 3 and 13, it will be seen that the gear box 140 drives a gear 143 which is engaged with a second gear 144 which is keyed to the cam shaft 54.

Figure 10:
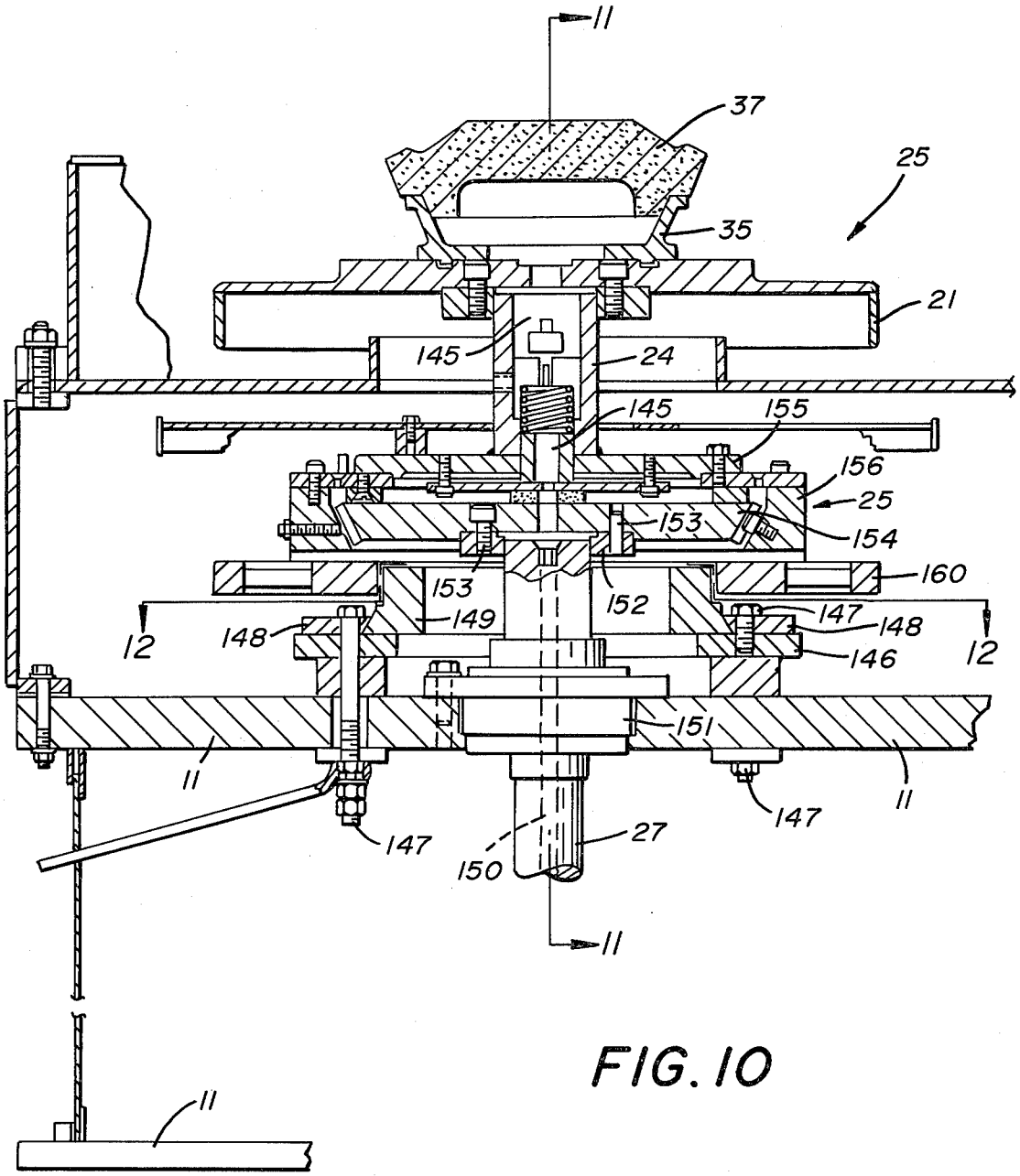
FIG. 10 is an enlarged detail of a front elevation with parts broken away and parts in cross section showing one of the eccentric motion devices used in the spreading and finishing stations of the oval dish former.
Figure 11:
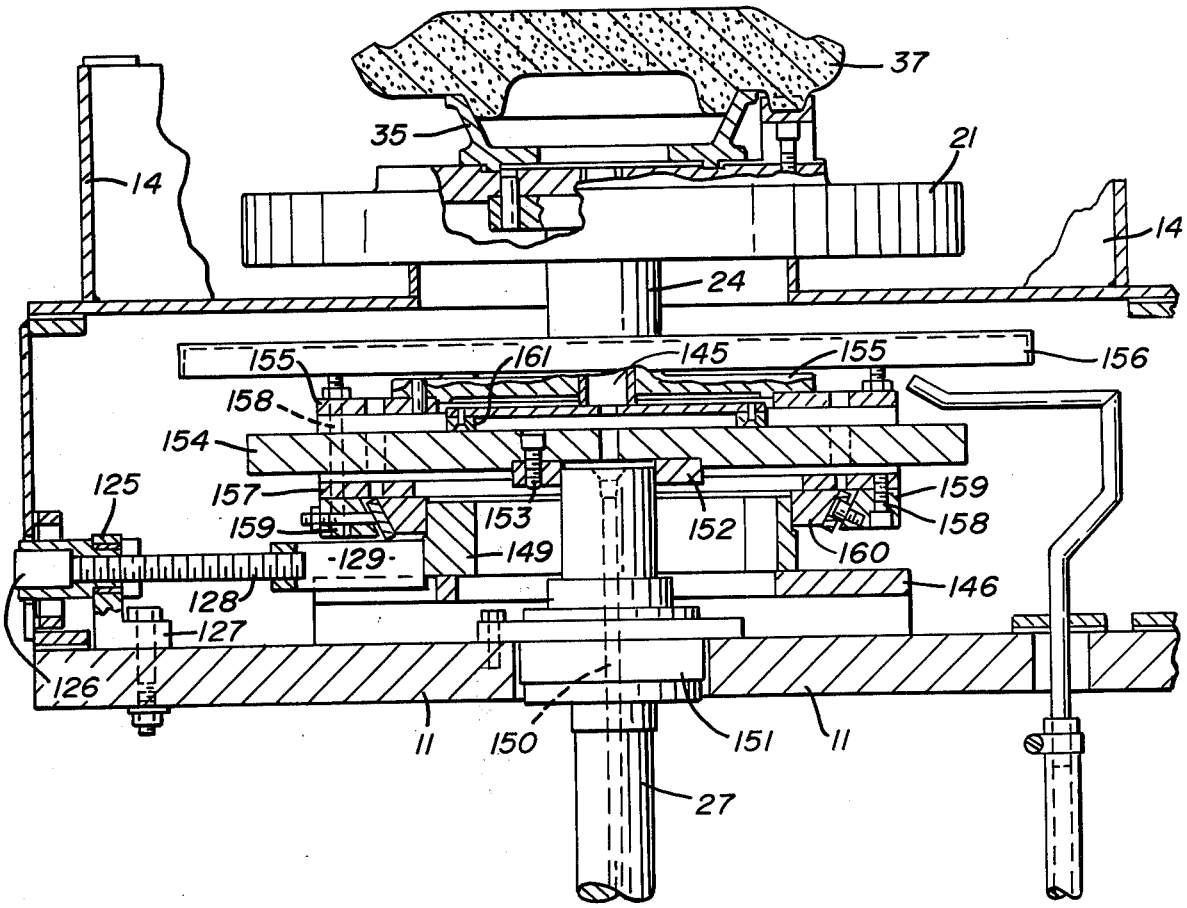
FIG. 11 is a similar view of the eccentric motion device of FIG. 10 shown in side elevation with parts broken away and parts in cross section.
Figure 12:
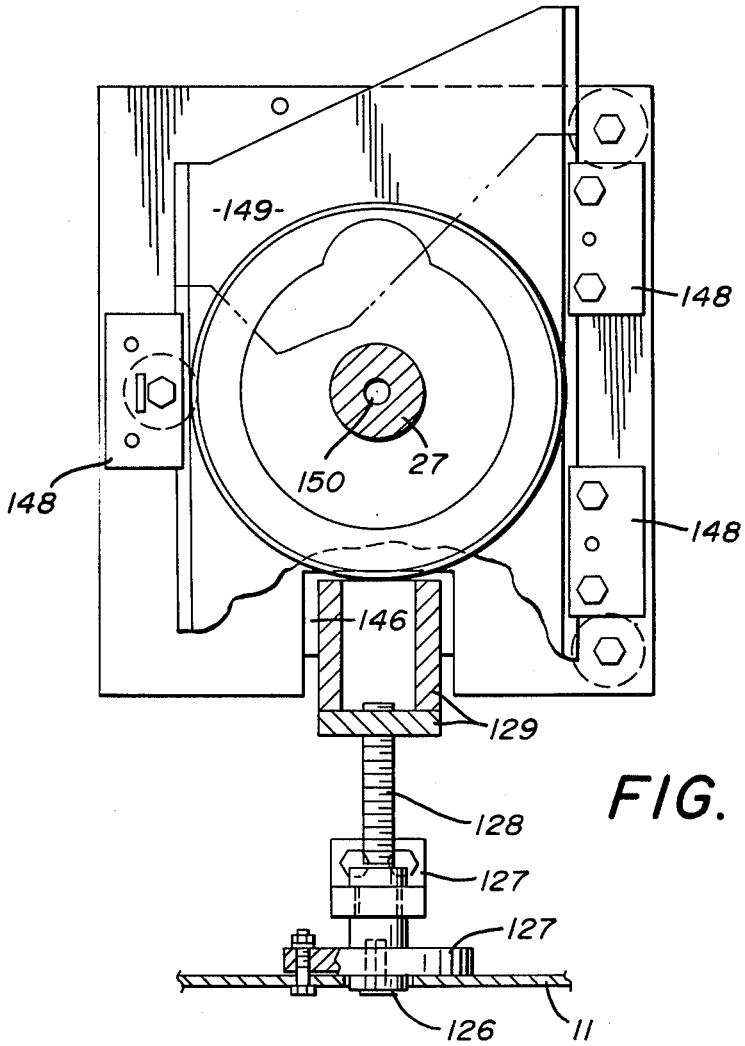
FIG. 12 is a top plan view of the eccentric motion device as shown on line 12—12 of FIG. 10.

By referring now to FIGS. 10 and 11 of the drawings, details of one of the eccentric motion devices 25 and 26 may be seen. In FIG. 10 a vertical section through the machine and the wheel 21 illustrates the uppermost surface thereof supporting the vacuum chuck 35 and one of the porous plaster mold and carriers 37. An opening in the center of the wheel 21 communicates with the interior of the vacuum chuck 35 and the interior of the spindle 24 is hollow to form a passageway 145 downwardly therethrough. The eccentric motion device 25 comprises an apertured frame 146 fastened to a portion of the support structure 11 by fasteners 147. Tapered parallel guides 148 are also attached to the apertured frame 146 by the fasteners 147 so as to slidably position a hollow body member 149. The spindle 27, which drives the eccentric motion device 25 and the wheel 21, has an axial passageway 150 longitudinally thereof and a bearing assembly 151 positions the spindle 27 in an opening in the supporting structure 11. A collar 152 is affixed to the upper end of the spindle 27 and fasteners 153 secure a driver slide 154 to the collar 152 so that rotary motion of the spindle 27 will be imparted to the driver slide 154. A top slide piece 155 is attached to the bottom of the spindle 24 which carries the wheel 21 and angular depending guides 156 on the edges of the top slide piece 155 partially underlie tapered edges on the driver slide 154 as best seen in FIG. 10 of the drawings.

By referring now to FIG. 11 of the drawings, it will be seen that an intermediate plate 157 is attached to the top slide piece 155 by fasteners 158 and that a pair of spaced parallel secondary angular guides 159 are positioned beneath the opposite ends of the flat plate 157 with their angular opposed surfaces extending inwardly and downwardly where they position a bottom slide piece 160 for reciprocal motion at right angles to the reciprocal motion of the top slide piece 155. The bottom slide piece 160 has a large opening therein which is in registry with the outer circular upper portion of the body member 149 heretofore referred to.

It will thus be seen that rotary motion of the spindle 27 on a fixed vertical axis rotates the driver slide 154, which is secured to the spindle 27 by way of a collar 152. The top slide piece 155 slidably engaging the opposite longitudinal edges of the driver slide 154, spins with the driver slide and centrifugal motion moves the top slide piece relative to the driver slide 54 as permitted by the positioning of the body member 149 so that a desired eccentric motion of the spindle 24, the wheel 21 and the vacuum chuck 35 are obtained. The clay shape on the porous plaster mold and carrier 37 thus oscillates in an oval pattern as illustrated in broken lines in FIG. 3 of the drawings.

The engagement of the clay batt in the spreading stage or station 12 by the cone-shaped spreader roller 64 therefore imparts its desired spreading and shaping action to the clay batt as it is formed in an oval shape by the eccentric travel of the oscillating revolving wheel 21 and the same oscillating revolving motion of the wheel 22 enables the finishing roller 114 to similarly shape and smooth the oval dish being formed by the oval dish forming machine.

As hereinbefore described, the vacuum chucks which hold the porous plaster mold and carrier 37 on each of the wheels 21 and 22 during the simultaneous spreading and finishing actions of the spreading and finishing stages of the machine, are actuated by the communication of a vacuum line with the passageways axially of the spindles 27 and 28. The vacuum is conveyed through the eccentric motion devices as illustrated in FIGS. 10 and 11 of the drawings, and by referring to FIG. 11 it will be observed that the upper end of the axial passageway 150 in the spindle 27 communicates with the interior of the collar 152 and through an opening in the driver slide 154, the top slide piece 155 being movable in a reciprocal motion relative to the driver slide 154 is provided with a sealing member 161 which forms a closure with respect to the middle portion of the top slide piece 155 and the area of the driver slide 154 about the opening therein. The vacuum thus communicates with the passageway 145 within the spindle 24 and with the vacuum chuck 35 by way of the opening in the center of the wheel 21 as hereinbefore described. The vacuum lines which communicate with the spindles 27 and 28 are shown in FIG. 2 of the drawings and are indicated by the numeral 141. They extend to a suitable source of vacuum or minus atmospheric pressure.

It will be seen that although the oval dish forming machine is shown as having a common drive means for the spreading and finishing stations, these may be individually driven if desired so long as they are appropriately controlled and those skilled in the art will observe that the oval dish forming machine disclosed herein provides a unique spreading and shaping action with respect to the clay batt being processed in the spreading stage of the machine which desirably spreads and shapes the clay which is then finished in the finishing stage to form a highly desirable clay shape free of air inclusions, excess water and most importantly strains in the clay itself so that a perfect piece of ceramic wear results when the clay piece is fired.

Although but one embodiment of the present invention has been illustrated and described, it will be apparent to those skilled in the art that various changes and modifications may be made therein without departing from the spirit of the invention and having thus described my invention

What I claim is:

1. An oval dish forming machine for shaping clay on molds, said machine comprising a pair of spaced rotatable mold supports, means for rotating said mold supports and simultaneously imparting eccentric motion thereto, a pair of spaced work heads pivotally supported on said machine with their free ends movable toward and away from said mold supports in arcuate patterns, a roller shaping tool and means on one of said work heads mounting said roller shaping tool for rotary motion, said means being movable in a rocking action and means for imparting rotary movement to said roller shaping tool, means for imparting rocking motion to said means mounting said roller shaping tool, a second roller shaping tool and means on the other one of said work heads rotatably mounting said second roller shaping tool, means for imparting motion to said work heads arranged to move said work heads on said arcuate patterns, the axis of rotation of the roller shaping tools being inclined to the vertical with the inclination of the first roller shaping tool being less than that of the second roller shaping tool whereby in use the first roller shaping tool is operative primarily to spread said clay over said rotatable mold support and the second roller shaping tool is operative primarily to finish the surface of the clay spread by the first roller shaping tool.

2. The oval dish forming machine set forth in claim 1 and wherein said means for imparting motion to said work heads comprises a cam shaft on said machine, cams on said cam shaft and portions of each of said work heads positioned adjacent said cams, cam followers on each of said portions of said work heads engaged on said cams.

3. The oval dish forming machine set forth in claim 2 and wherein a pair of pivot shafts are positioned on said machine in spaced relation and on a common longitudinal axis, said work heads pivotally engaging said pivot shafts, and wherein said cam shaft is positioned on said machine in spaced parallel relation to the longitudinal axis of said pivot shafts.

4. The oval dish forming machine set forth in claim 1 and wherein said work head carrying said first mentioned roller shaping tool comprises a structure of sufficient weight to progressively engage said first mentioned roller shaping tool in a clay batt on a mold on the rotatable mold support therebeneath so as to spread said clay over said mold and shape the same.

5. The oval dish forming machine set forth in claim 2 and wherein a tensioning arm is positioned on said work head carrying said first mentioned roller shaping tool and in oppositely disposed relation to the free end thereof and wherein a piston and cylinder assembly is movably mounted on said oval dish forming machine with a piston rod of said piston and cylinder assembly engaging said tensioning arm so that motion originated by said piston and cylinder assembly and imparted said tensioning arm increases the tension applied to said first mentioned roller shaping tool and is controlled by the cam follower on the portion of the work head carrying said first mentioned roller shaping tool and the engagement of said cam follower on one of said cams and a source of fluid pressure and means controlling the same and in communication with said piston and cylinder assembly.

6. The oval dish forming machine set forth in claim 2 and wherein said means on one of said work heads mounting said first mentioned roller shaping tool comprises a rocker arm, a pivot on said work head outwardly of said mounting means, said rocker arm pivoted to said pivot, a rocker shaft pivotally engaging said rocker arm and extending to a point on said machine adjacent said cam shaft, a secondary rocker arm on said machine engaging one of said cams on said cam shaft, said rocker shaft being pivotally engaged on said secondary rocker arm whereby rocking action is imparted to said first mentioned roller shaping tool when said cam shaft revolves.

7. The oval dish forming machine set forth in claim 2 and wherein said means on one of said work heads mounting said first mentioned roller shaping tool comprises a rocker arm, a pivot on said work head outwardly of said mounting means, said rocker arm pivoted to said pivot, a rocker shaft pivotally engaging said rocker arm and extending to a point on said machine adjacent said cam shaft, a secondary rocker arm on said machine engaging one of said cams on said cam shaft, said rocker shaft being pivotally engaged on said secondary rocker arm whereby rocking action is imparted to said first mentioned roller shaping tool when said cam shaft revolves, and wherein spring tensioning means is positioned between said work head and said rocker arm and arranged to urge said rocker arm in a direction opposite to the direction imparted said rocker arm by said secondary rocker arm and rocker shaft.

8. The oval dish forming machine set forth in claim 1 and wherein vacuum actuated chucks are incorporated in said rotatable mold supports, a vacuum source for said vacuum chucks and means responsive to one of said cams on said cam shaft for actuating said vacuum chucks.

9. The oval dish forming machine set forth in claim 1 and wherein said means for imparting rotary movement to said roller shaping tool comprises a motor mounted on said work head, a gear box and a pulley driven thereby, a shaft on said roller shaping tool, a secondary pulley on said shaft and a belt trained over said pulleys and a switch controlled circuit for energizing said motor.

10. The oval dish forming machine set forth in claim 2 and wherein said work heads are pivotally supported inwardly of their ends on said pivot shafts whereas to position the free ends outwardly of one side of said pivot shafts and the portions of each of the work heads carrying the cam followers on the opposite sides of said pivot shafts and substantially closer thereto than said free ends of said work heads.

11. The oval dish forming machine set forth in claim 1 and wherein said first mentioned roller shaping tool comprises a cone-shaped spreader roller having an axially extending drive shaft and wherein said means on one of said work heads mounting said first mentioned roller shaping tool comprises a bearing and wherein said drive shaft and said bearing are arranged to position said first mentioned roller shaping tool in angular relation to clay on a mold on one of said mold supports.

12. The oval dish forming machine set forth in claim 1 and wherein said first mentioned roller shaping tool comprises a cone-shaped spreader roller having an axially extending drive shaft and wherein said means on one of said work heads mounting said first mentioned roller shaping tool comprises a bearing and wherein said drive shaft and said bearing are arranged to position said first mentioned roller shaping tool in angular relation to clay on a mold on one of said mold supports, and wherein said bearing is pivotally mounted in said work head whereby the angle of engagement of said first mentioned roller shaping tool on said clay on said mold on said rotatable mold support may be continuously changed so as knead said clay during said spreading and shaping thereof.

13. The oval dish forming machine set forth in claim 1 and wherein said second roller shaping tool comprises a dumbbell shaped roller having axially extending shafts at its end engaging said means on said other one of said work heads, a braking device adjacent said second roller shaping tool and means responsive in operation to at least one of said rotatable mold supports for actuating said braking device so as to stop the free rotation of said second roller shaping tool whereby said tool slidably engages clay on a mold on said rotatable mold support to impart a smooth finish thereto.

14. The oval dish forming machine set forth in claim 1 and wherein said means on the other one of said work heads rotatably mounting said second roller shaping tool comprises a support plate having depending portions journaling said second roller shaping tool.

15. The oval dish forming machine set forth in claim 1 and wherein said means on the other one of said work heads rotatably mounting said second roller shaping tool comprises a support plate having depending portions journaling said second roller shaping tool and wherein fasteners detachably adjustably secure said support plate to said other one of said work heads.

* * * * *